United States Patent [19]

Protano et al.

[11] 4,094,022

[45] June 13, 1978

[54] APPARATUS FOR THE REMOVAL OF WATER FROM A SWIMMING POOL DUCT

[76] Inventors: Dominic R. Protano, 10 Woodside Dr.; Ronald L. Conte, 63 Keith Hill Rd., both of Grafton, Mass. 01519

[21] Appl. No.: 743,685

[22] Filed: Nov. 22, 1976

[51] Int. Cl.[2] ..... E04H 3/16; E03B 11/00

[52] U.S. Cl. ..... 4/172.17; 137/590

[58] Field of Search ..... 4/172.15, 172.16, 172.17; 137/590

[56] References Cited

U.S. PATENT DOCUMENTS 3,858,597 1/1975 Pramenko ..... 137/590

*Primary Examiner*—Steven L. Stephan

*Attorney, Agent, or Firm*—Norman S. Blodgett; Gerry A. Blodgett

[57] ABSTRACT

Apparatus for use with a swimming pool having a drain opening on a vertical surface, the apparatus consisting of an open-topped, open-sided enclosure with edges which engage the surface around the drain and with a pump on the interior for removing water.

6 Claims, 3 Drawing Figures

APPARATUS FOR THE REMOVAL OF WATER FROM A SWIMMING POOL DUCT

BACKGROUND OF THE INVENTION

In those regions of the country where freezing temperatures are encountered in the winter, it is necessary to remove water from the various conduits of swimming pools. If this is not done the water freezes, expands, breaks the conduits, and may even damage pumps and filters. Since all of the conduits are pitched toward the openings in the walls of the pool, the normal practice is to lower the level of water in the pool until it is below these openings, so that the water drains from the openings into the body of the pool. Once the drain openings have been cleared, it is possible to insert plugs into the openings and then refill the pool. Two problems are encountered in carrying out this procedure. First of all, it is a time-consuming procedure and it wastes a considerable amount of water, particularly in the case of a large pool. Secondly, and more importantly, while the procedure is being carried out, the pool wall is unsupported and it is possible for the pool to be damaged during this period of non-support. Hydraulic ground pressure can act on these unsupported portions of the pool during the draining procedure and can cause the pool walls to buckle or crack. These and other difficulties experienced with the prior art procedures have been obviated in a novel manner by the present invention.

It is, therefore, an outstanding object of the invention to provide an apparatus for use with a swimming pool to remove water from pool passages without removing large amounts of water from the pool proper.

Another object of this invention is the provision of an apparatus for permitting the drainage of water from swimming pool conduits without danger of buckling or cracking of the pool walls due to lack of support.

A further object of the present invention is the provision of an apparatus for a pool-draining procedure, which apparatus is simple in construction, which is inexpensive to manufacture, and which is capable of a long life of useful service without the need for maintenance.

It is another object of the instant invention to provide an apparatus for carrying out a method of draining pool passages without a time-consuming and wasteful removal of a large portion of the pool contents.

A still further object of the invention is the provision of an apparatus including a box-like barrier for isolating swimming pool drains from the main body of water in the pool.

With these and other objects in view, as will be apparent to those skilled in the art, the invention resides in the combination of parts set forth in the specification and covered by the claims appended hereto.

SUMMARY OF THE INVENTION

In general, the invention consists of an apparatus for use with a swimming pool having a drain opening located on a vertical surface of the pool. The apparatus is provided with a main body consisting of a vertical wall of U-shaped cross-section with a bottom wall extending under it. The vertical wall has two vertical edges which are spaced to contact the said surface of the pool on either side of the drain opening and has an upper edge adapted to lie above the level of water in the pool. The bottom wall has a horizontal edge which contacts the surface under the drain opening and is connected at its ends to the other vertical edges. A pump is mounted on the interior of the main body and has an inlet located adjacent the bottom wall and an outlet extending over the upper edge.

More specifically, the main body consists of a flat rear wall and two side walls which extend at right angles to it. The vertical edges of the side walls and the horizontal edge of the bottom wall are provided with an elastomer sealing strip, so that the pump can remove water from the enclosure defined by the main body and the said surface of the pool without water leaking back into the enclosure around the contact edges.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
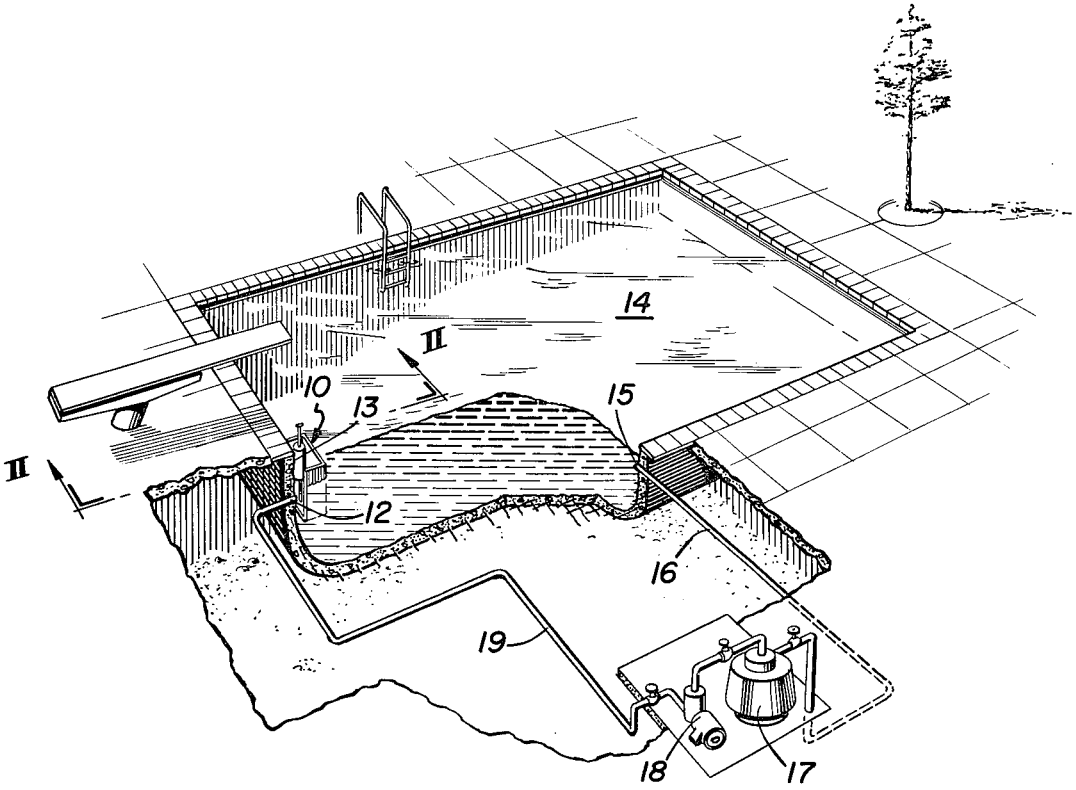
FIG. 1 is a perspective view of an apparatus embodying the principles of the present invention, shown in use with a swimming pool.

Referring first to FIG. 1, wherein are best shown the general features of the invention, the apparatus, indicated generally by the reference number 10, is shown in use with a conventional below-ground swimming pool 11. The swimming pool is provided with a drain opening 12 on a vertical wall surface 13. The body 14 of water resides in the pool and the opening 12, as well as a similar intake opening 15, resides below the upper level of the water in its normal condition. From the opening 15 extends a conduit 16 leading to a filter 17 and a pump 18. From the pump extends a conduit 19 leading to the drain opening 12. Normally, the conduits 16 and 19 are arranged in such a way that they pitch downwardly toward their respective openings 15 and 12.

Figure 2:
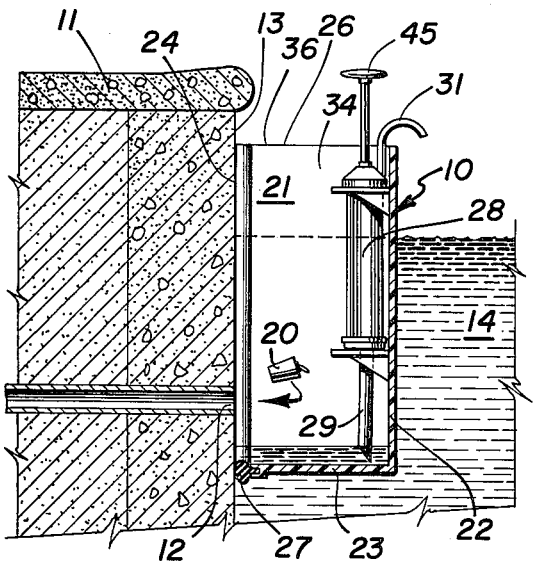
FIG. 2 is a vertical sectional view of the apparatus taken on the line II—II of FIG. 1.
Figure 3:
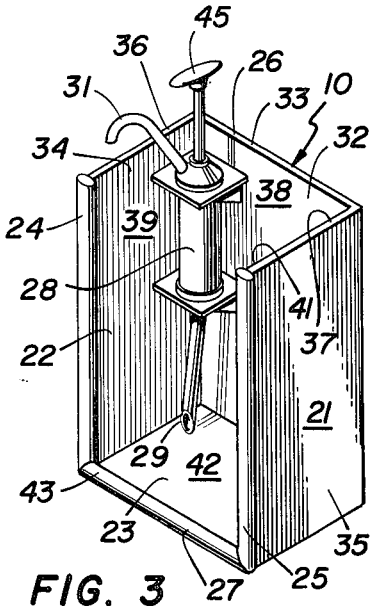
FIG. 3 is a perspective view of the apparatus when not in use.

Referring to FIGS. 2 and 3, it can be seen that the apparatus 10 is provided with a main body 21, consisting of a vertical wall 22 and a bottom wall 23. The main body 22 has a generally trough-like configuration with a cross-section in the form of an open, plane figure. It has two spaced edges 24 and 25 adapted to contact the surface 13 of the pool wall on either side of the drain opening 12. It also has an upper edge 26 normally lying above the level of the body 14 of water in the pool. The bottom wall has a horizontal edge 27 adapted to contact the surface 13 below the opening 12, the edge 27 joining the bottoms of the edges 24 and 25 of the vertical wall. In the interior of the vertical wall is mounted a pump 28 having an outlet pipe 31 which extends over the upper edge 26 of the vertical wall.

The vertical wall 22 is formed with a rear wall 32 which is adapted to lie in spaced relationship to the surface 13 with an upper edge 33 located above the level of the water in the pool. The vertical wall 22 also is provided with two side walls 34 and 35 which extend from the rear wall 32 toward the surface 13. The sidewalls 34 and 35 are provided with upper edges 36 and 37. These edges are located above the level of the water in the pool and are provided with the vertical edges 24 and 25 which contact the surface 13. The side walls 34 and 35 are spaced and parallel, so that the edges 24 and 25 lie on either side of the drain opening. The bottom wall 23 connects the rear wall 32 and the side walls 34 and 35.

The rear wall 32 has a vertical, plane, inner surface 38 which is located in spaced, parallel relationship with the pool surface 13. The side walls 34 and 35 are provided with vertical, plane, inner surfaces 39 and 41, respectively, and these are located in spaced, parallel relationship to each other and at right angles to the inner surface 38 of the rear wall. The bottom wall 23 has a plane horizontal inner surface 42.

The vertical edges 24 and 25 of the side walls are straight lines, while the horizontal edge 27 of the bottom wall 23 is also straight. These edges are provided with a continuous sealing strip 43 which is formed of an elastomer material and which has a generally oval shape cross-section, as is evident in FIG. 2. The pump 28 consists of an elongated cylinder 44 mounted vertically in a corner between the rear wall 32 and the side wall 34 and is provided with an operating plunger 45 extending from its upper end. The inlet pipe 29 extends from the lower end of the cylinder toward the bottom wall 23 and the outlet pipe 31 extends from the upper end of the cylinder and is bent over the edge 36 of the sidewall 34. In the preferred embodiment, the walls 32, 34 and 35 and the pump 28 are formed of a plastic material, such as polyvinyl chloride.

The operation and the advantages of the present invention will be readily understood in view of the above description. By using the present invention, it is possible to remove the water from the exits of the conduits 16 and 19 and to insert plugs therein without draining the pool. For this purpose, the apparatus 10 is applied to the surface 13 of the pool with the upper edges lying above the level of the water, as shown in FIG. 2. The edges 24, 25, and 27 which lie against the surface, are provided with the sealing strip 43 which makes a water-tight connection therewith. The pump is operated by pressing up and down on the actuating plunger 45, so that water is removed from the interior and is expelled through the pipe 31 into the main body of the pool. As soon as the level of water in the enclosure is lowered slightly, hydraulic pressure then clamps the apparatus tightly against the pool wall, so that no water can leak back in. Each conduit drains down into the inner portion of the box when the box is applied to it and this liquid is also removed with the pump. Eventually, the conduits are empty and the user reaches down inside of the enclosure and inserts a suitable plug 20 in the drain opening 12 and (at a later time) to the drain opening 15. The apparatus is then removed and, possibly, subsequently applied to another drain. It can be seen, then, that it is not necessary to drain the pool to any great extent. The apparatus is moved around to each of the openings that need to be drained and is of a large enough design to bracket around any of the openings. For instance, if the skimmer opening is quite large, the apparatus is large enough to reach around it. In this way, it can be seen that the pool wall is not left in an unsupported condition, so that it is not possible to have the wall of the pool buckle or crack due to that condition. In addition, it is a fairly rapid operation to drain and plug the conduits; it can be done in a very short period of time and there is no waste of water.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Apparatus for use with a swimming pool having an opening on a vertical surface, comprising:
   (a) a rear wall adapted to lie in a spaced relationship to the said surface with an upper edge located above the level of the water in the pool,
   (b) two side walls extending from the rear wall toward the said surface, each wall having an upper edge located about the level of the water in the pool and a vertical edge adapted to contact the said surface, the side walls being substantially spaced to allow the vertical edges to lie on either side of the opening,
   (c) a bottom wall connecting the rear and side walls and having a horizontal edge adapted to engage the said surface beneath the opening,
   (d) a pump mounted on the interior of the walls, the pump extending above the upper edges of the walls, and
   (e) a continuous sealing strip of elastomer material extending along the vertical edges of the side walls and the horizontal edge of the bottom wall, the rear wall having a vertical plane inner surface located in spaced, parallel relationship with the said pool surface, the side walls having vertical plane inner surfaces that are located in spaced, parallel relationship to each other, each side wall inner surface extending at a right angle to the inner surface of the rear wall to form a corner, the pump being mounted in one of the said corners to form a rigid structure therewith.

2. Apparatus as recited in claim 1, wherein the bottom wall has a plane horizontal inner surface.

3. Apparatus as recited in claim 1, wherein the vertical edges of the side walls are straight, and the horizontal edge of the bottom wall is also straight.

4. Apparatus as recited in claim 1, wherein the pump consists of an elongated cylinder mounted vertically in the corner between the rear wall and a side wall with an operating plunger extending from the upper end, an inlet pipe extending from the lower end toward the bottom wall and an outlet pipe extending from the upper end and over an upper edge.

5. Apparatus as recited in claim 1, wherein the walls and the pump are constructed of a plastic material.

6. Apparatus as recited in claim 1, wherein the walls are formed of a clear plastic.

* * * * *